United States Patent [19]

Heider et al.

[11] Patent Number: 4,779,026

[45] Date of Patent: Oct. 18, 1988

[54] RAPID-START HIGH-PRESSURE DISCHARGE LAMP, AND METHOD OF ITS OPERATION

[75] Inventors: Jürgen Heider, Munich; Jürgen Vom Scheidt, Taufkirchen, both of Fed. Rep. of Germany

[73] Assignee: Patent Treuhand Gesellschaft fur Elektrische Gluhlampen m.b.H., Munich, Fed. Rep. of Germany

[21] Appl. No.: 39,662

[22] Filed: Apr. 17, 1987

[30] Foreign Application Priority Data

May 14, 1986 [DE] Fed. Rep. of Germany ..... 3616192

[51] Int. Cl.[4] ..... H01J 61/073; H01J 61/54; H05B 31/30

[52] U.S. Cl. ..... 313/631; 313/595; 315/46

[58] Field of Search ..... 313/595, 574, 575, 631, 313/632, 638; 315/46, 47, 48, 49, 169.1

[56] References Cited

U.S. PATENT DOCUMENTS 3,519,872 7/1970 Ward ..... 313/601
3,937,996 2/1976 Cap ..... 313/631
4,459,510 7/1984 Joormann ..... 313/638 X

FOREIGN PATENT DOCUMENTS 155645 9/1983 Japan ..... 313/638

*Primary Examiner*—David K. Moore
*Assistant Examiner*—K. Wieder
*Attorney, Agent, or Firm*—Frishauf, Holtz, Goodman & Woodward

[57] ABSTRACT

To provide for pre-heating of low-power small metal halide high-pressure discharge lamps (1), at least one of the electrodes (16) is formed as a heater wire by introducing a thin tungsten wire, in V shape, into one end of the elongated bulb (2), and carrying out each one of the legs of the V, separately, and electrically insulated within an end press seal (4) by parallel foils (10, 11) externally of the bulb. Continuous heater current is caused to flow through the V-shaped wire electrode, thus heating the discharge vessel, to complete vaporization of the fill. To start the lamp, the two legs of the V, of the heater electrode, are connected in parallel and across the lamp operating voltage and then a high-voltage pulse is applied between the V-shaped heater electrodes, for example between one or both of the external conductors and the other electrode (9). Light output, upon starting, is substantially accelerated from a lamp of this type with respect to non-preheated lamps.

20 Claims, 3 Drawing Sheets

RAPID-START HIGH-PRESSURE DISCHARGE LAMP, AND METHOD OF ITS OPERATION

Reference to related patent, the disclosure of which is hereby incorporated by reference:

U.S. Pat. No. 3,519,872, Ward.

The present invention relates to high-pressure discharge lamps, and more particularly to high-pressure discharge lamps which include a metal halide, and which require a high voltage pulse to initiate a discharge between two electrodes.

BACKGROUND

Metal halide high-pressure discharge lamps require starting pulses to initiate the discharge across spaced electrodes. The efficiency of energy conversion to light obtainable from such lamps is high, with good color temperature. These lamps do not, however, provide light immediately upon energization but, rather, require some starting time.

A metal halide high-pressure discharge lamp has been describefd in U.S. Pat. No. 3,519,872, Ward, in which a fine heating wire made of coil-coiled tungsten is serially connected with the main electrode. The respective free ends of the electrode and of the heating coil are connected to a current supply, each, which is, electrically insulated from each other, conducted through a pinch or press seal or melt seal of the discharge vessel. The arrangement improves the ignition characteristics of the lamp since heat which can be obtained from the heating coil heats the discharge electrode. Fill condensates which possibly precipitated on the electrode are thereby vaporized. The fine heating wire, typically a fine tungsten wire, cannot, in high-power lamps, heat the entire discharge vessel. Thus, other than facilitating ignition, due to more rapid stabilization of the discharge, no further advantages can be obtained thereby.

Metal halide high-pressure lamps are used more and more for general purpose illumination and, also, have been proposed as headlamps for vehicular use. The power rating of such lamps is low—100W and less, and, especially, 50W and less. The color temperature of such lamps must be acceptable and pleasing to users; additionally, the light output to be obtained from the lamps should rapidly occur upon energization of the lamps.

The discharge vessel of low-power lamps of this type is very small. A typical volume is in the order of about 0.03 $cm^3$. It is not possible to introduce heater coils or heater windings in such small discharge vessels. Lamps with high power, and having substantial discharge vessels, may have heater wires placed therein.

THE INVENTION

It is an object to provide a metal halide high-pressure discharge lamp, and especially a metal halide high-pressure discharge lamp of small power, which provides a high percentage of rated light output rapidly, after energization of the lamp.

Briefly, the lamp is a double-ended lamp of small volume. At least one of the electrodes is shaped and dimensioned to have a narrow V form, with the apex of the V facing the other electrode of the lamp, and each leg of the V being separately carried through the pinch or press seal of the respective end of the lamp, insulated from each other. A molybdenum foil connection is preferably used.

The second electrode of the lamp may be conventional or, in accordance with a feature of the invention, may likewise be a V electrode with the two legs thereof carried out of the respective other pinch or press seal, separately. The lamp is operated by first pre-heating the filament which, preferably, is an uncoiled single tungsten wire which is pre-heated by applying a current at low voltage thereto. If it is desired to start the lamp, a high voltage pulse is applied between the spaced, opposite electrodes and, as soon as the lamp has fired, the current supply leads to the two legs of the V are disconnected from the current supply and, rather, connected in parallel and to the ordinary current supply for the lamp, for example through a ballast.

The arrangement has the advantage that, even with discharge vessels or bulbs which have a volume as small as about 0.03 $cm^3$, and incapable of retaining a separate heating filament, the tungsten wire can be used to provide the necessary pre-heating. The wire, preferably, is a single tungsten wire, bent in narrow V configuration and, for example, directly welded to molybdenum foils which are pinch-sealed in the respective end or ends of the bulb or discharge vessel. The usual pinch or pinch seal is big enough to accept two current supply leads, insulated from each other next to each other. The voltage beteeen these two separate current supply leads is low, and thus wide separation is not needed. During pre-heating, only heating current flows through the current supply leads from external leads through the molybdenum foils and to the V tungsten wire. After firing or ignition of the lamp, both current supply leads, upon disconnection of the heater supply current, are connected in parallel to carry the operating current in parallel.

The pre-heated metal halide high-pressure discharge lamps provide light output substantially faster than prior art lamps. For example, 30% of light output is obtained 5 times as fast; 50% light output 4 times as fast; 90% of the light output is obtained $2\frac{1}{2}$ times as fast as prior art lamps, or as similar lamps which are cold-started, that is, without pre-heating.

In accordance with a feature of the invention, both electrodes are constructed as V-shaped heater electrodes; this permits even faster starting and obtaining of light from the lamp; or to permit use of a bulb or discharge vessel having a greater volume, and thus permitting higher light output from the lamps.

DRAWINGS

DETAILED DESCRIPTION

Figure 1:
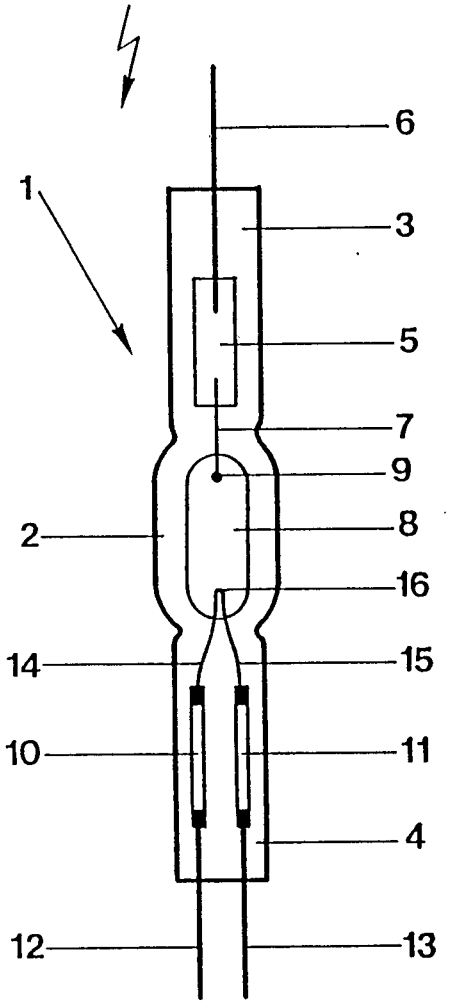
FIG. 1 is a schematic side view of a lamp in accordance with the present invention.

Referring first to FIG. 1: The metal halide high-pressure discharge lamp 1 has an elongated bulb or discharge vessel 2 made of quartz. Opposite ends of the quartz are formed with pinch or press seals 3, 4. A sealing foil 5 of molybdenum is located in pinch seal 3, connected to an external current supply lead 6. The current supply lead 6 is connected through the molybdenum foil 5 with an internal current supply lead 7, of tungsten, which terminates in a ball-shaped electrode 9. Electrode 9 is located within the discharge or arc space 8 of the bulb 2 of lamp 1.

The other end of bulb 2 is formed with a pinch seal 4 which retains two narrower sealing foils 10, 11, also of molybdenum. Foils 10, 11 are electrically insulated from each other, and, as best seen in FIG. 1, spaced from each other, and embedded in parallel relationship in the pinch seal. External current supply leads 12, 13 are connected to the respective foils 10, 11.

In accordance with a feature of the invention, a heater electrode 16, having within the discharge space 8 a V shape with internal current supply leads 14, 15 forming part of the legs of the V, is connected, for example by welding, to the foils 10, 11. Thus, the internal current supply leads 14, 15 are welded to foils 10, 11, as schematically shown in FIG. 1.

The discharge space 8 has a volume of about 0.03 $cm^3$. The V-shaped portion of the heater electrode 16 extends into the discharge space 8 by about 2.5 mm. The heater electrode 16, itself, is formed of an uncoiled straight—except for the V bend—wire of tungsten of about 0.15 mm diameter. The distance or spacing between the electrode 9 and the apex of the electrode 16 is about 4.5 mm. A fill of about 1 mg mercury, as well as sodium halide, tallium halide and tin halide of, overall, about 0.3 mg, and argon, is filled into the arc tube space 8. The argon forms the starting gas; the operating pressure of the lamp is about 40 bar. In operation, the color temperature of the lamp with the fill as given is about 3600 K.

Operation: The heater electrode 16 is pre-heated by applying to current supply leads 12, 13 a voltage of about 2.8V, resulting in a current of about 5.5A. This current is supplied to the lamp before it is started, and may flow for some time before the lamp is intended to be lit. The discharge vessel 2, thus, is continuously held at a temperature in which the fill components are at least partly vaporized. To obtain light from the lamp, the lamp 1 is ignited or started by applying a pulse of about 16 kV between the electrodes 9 and 16. The pulse is applied to the electrode 9 by connecting it to the external lead 6 and to one or, via a transformer T (FIG. 4) to both of the external leads 12', 13'. As soon as the lamp is started, the heater circuit for the V electrode 16 is interrupted. An operating current of about 0.35A is then conducted, in parallel, to the external leads 12, 13 and hence to the electrode 16. At an arc voltage of about 100V, electric power consumption of the lamp is about 35 W.

Figure 2:
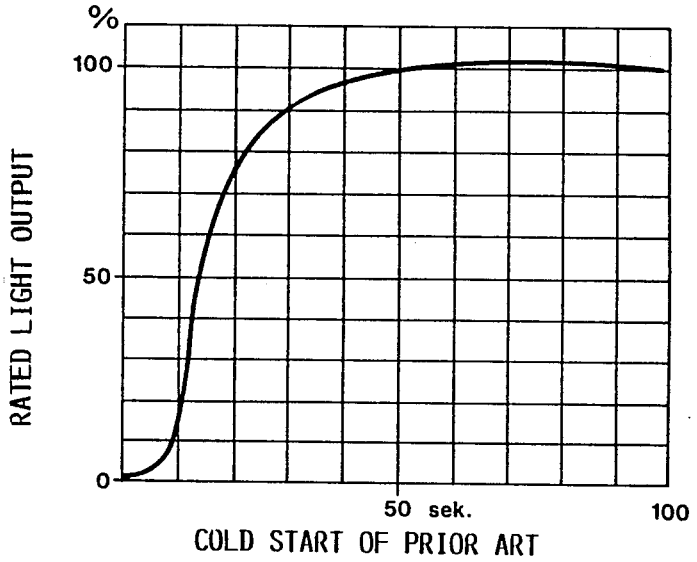
FIG. 2 is a graph of rated light output in percent (ordinate) vs. time (abscissa) of a cold-started metal halide high-pressure lamp operated in accordance with the prior art.
Figure 3:
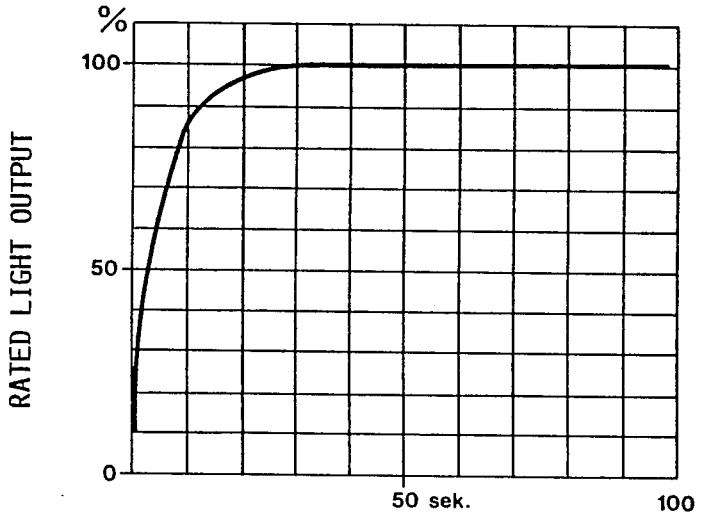
FIG. 3 is a graph similar to FIG. 2, illustrating the light output from the lamp in accordance with the present invention.

FIGS. 2 and 3 illustrate, graphically, the comparison of starting speed and light output of a lamp operated conventionally, that is, without pre-heating and without applying heater current to the external leads 12, 13 (FIG. 2) and, in FIG. 3, to operating the lamp by pre-heating, as described.

FIGS. 2 and 3 illustrate the difference, and clearly show that with the pre-heated lamp (FIG. 3), after about 2.3 seconds, about 30% of light output flux is obtainable. This corresponds to about 1000 lumens, which is approximately the light output of a conventional H4 halogen incandescent lamp. After only about 3.7 seconds, 50% of the rated light output of the high-pressure discharge lamp is obtained; 90% of rated light output is obtained after about 11.9 seconds, at which the final light output of about 2650 lumens, corresponding to 100% of rated light, is reached. In contrast, and for comparison, a lamp which is an all respects similar except that it does not have the pre-heated electrode 16—that is, for example two identical electrodes 9 or an electrode 16 to which no heater current has previously been applied—requires 11.8 seconds to reach 30% of light output, 14.6 seconds to reach 50% light output, and 28.7 seconds, that is, almost half a minute, to obtain 90% of light output. The color temperature of the lamp with the fill, as noted, is about 3600K.

Figure 4:
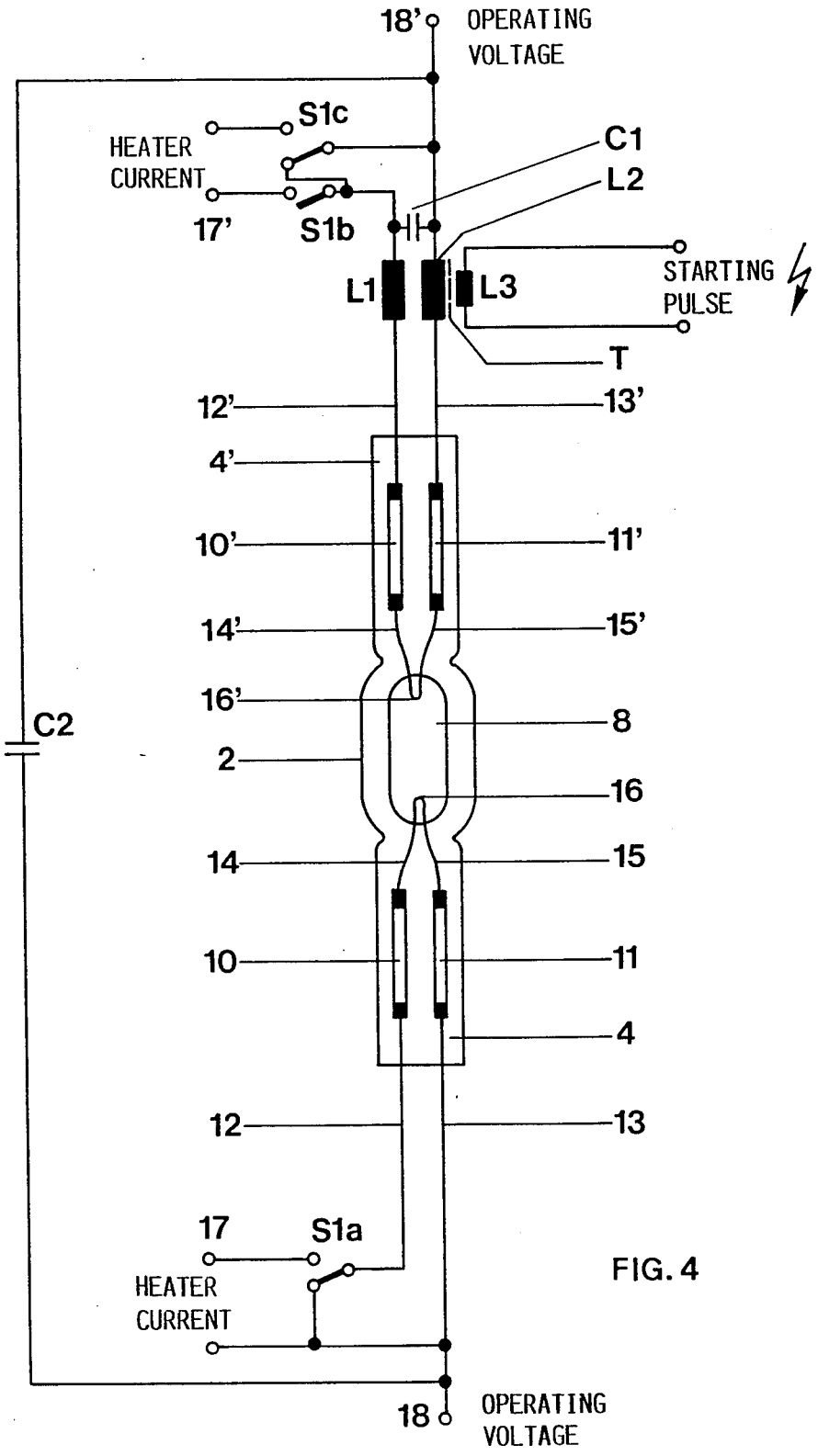
FIG. 4 is a view similar to FIG. 1, and showing a lamp having two preheater-type filaments in accordance with the present invention.

FIG. 4 illustrates a double-heated lamp. The lower half of the lamp of FIG. 4 is identical to that shown in FIG. 1; the upper half is the mirror image of the lower half, and reference numerals used in FIG. 1 have been used identically, or, respectively, with prime notations, where appropriate, to show the components forming the mirror image of the lower part of FIG. 1.

FIG. 4 also illustrates the circuit. A pulse transformer T having two parallel wound secondary windings L1 and L2 with low ohmic resistance is connected to the respective external current supply leads 12', 13'; its primary winding L3 permits application of a high voltage starting pulse to the electrode 16'. Heater current can be applied through heater current terminals 17, 17' and through switch S1, with its contacts a, b, c being in the heating position. Prior to the firing of the lamp 1, the switch S1 is moved to its operating position, thereby removing the heater current energy from terminals 17, 17' and short-circuiting the external supply leads 12, 13 and 12', 13'. Operating voltage can then be connected between terminals 18, 18', Capacitors C1 and C2 are included to short-circuit high voltage or high frequency respectively for safety of the operating voltage device. Other circuit arrangements may be used, as appropriate, for example by connecting the starting pulse to both of the opposed external current supply leads 12, 13 and 12', 13' of the lamp 1.

Various changes and modifications may be made, and features described in connection with one of the embodiments may be used with the other, within the scope of the inventive concept.

Pre-heating of lamps is particularly effective for small metal halide high-pressure discharge lamps up to about 50W capacity, which means a vessel having an internal volume in the order of about 0.03 $cm^3$. The invention is applicable, however, with lamps having different internal bulb volumes, and especially small bulbs with internal volumes to about 1 $cm^3$, or even above, and, especially, in any arrangement where it would be difficult or inconvenient to provide separate pre-heater wires and where the electrode structure for pre-heating can be readily formed and dimensioned to provide for pre-heating of the interior space of the bulb, with reasonable current consumption, to an extent sufficient to vaporize the fill content within the bulb.

We claim:

1. High-pressure discharge lamp having a double-ended, elongated bulb structure (2) formed with two pinch or press seals (3, 4) located at respective end of the bulb structure;

a fill including a metal halide in said bulb structure;

two external current supply leads (6; 12, 13) conducted into at least one of the pinch or press seals in gas-tight manner;

internal current supply leads (7; 14, 15) connected to the external current supply leads and extending from respective pinch or press seals internally of the bulb structure (2);

and electrodes (9, 16) connected to said internal current supply leads, wherein, in accordance with the invention, the electrodes are shaped and connected to permit heating of the fill in the bulb to provide for rapid rated light output upon high voltage pulse energization across the electrodes, at least one (16) of the electrodes is shaped and dimensioned to have narrow V form with the apex of the V facing the other electrode, and each leg of the V of said at least one electrode (16) forms an individual internal current supply lead (14, 15) and is connected to a respective one of said two external current supply leads (12, 13), separately, and insulated from each other, and individually passed through the respective pinch or press seal to permit heating of said at least one electrode by an energy source connected across said two external current supply leads (12, 13).

2. The lamp of claim 1, wherein connecting foils (5; 10, 11) are provided, located within respective pinch or press seals and connecting respective internal and external current supply leads within the respective pinch or press seal, the foils connected to the respective legs of said at least one V-shaped electrode (16) being narrow elongated strips spaced from and electrically insulated from each other within the respective pinch or press seal (4).

3. The lamp of claim 1, wherein said at least one V-shaped electrode (16) comprises an uncoiled tungsten wire element.

4. The lamp of claim 1, wherein the power rating of said lamp is only up to about 50W.

5. The lamp of claim 2, wherein the power rating of said lamp is only up to about 50W.

6. The lamp of claim 1, wherein two electrodes are provided, and both said electrodes are shaped and dimensioned to have said narrow V form;

and wherein both of said electrodes have the respective legs of the resepctive V representing individual internal current supply leads and being separately connected to individual ones of said external current supply leads.

7. The lamp of claim 6, wherein connecting foils (10', 11', 10, 11) are provided, located within respective pinch or press seals (3', 4) and connecting respective internal and external current supply leads within the respective pinch or press seals, the foils connected to the respective legs of said two V-shaped electrodes (16', 16) being narrow elongated strips spaced from and electrically insulated from each other within the respective pinch or press seal (3', 4).

8. The lamp of claim 6, wherein both said V-shaped electrodes (16, 16') comprise uncoiled tungsten wire elements.

9. The lamp of claim 1, wherein the internal volume of said bulb structure, within which said electrodes are located, is in the order of up to about 1 $cm^3$, and the at least one V-shaped electrode extends within the bulb structure and is dimensioned and shaped to provide for heating of the interior of the bulb structure, when energized by the energy source to effect vaporization of the fill within the bulb structure.

10. A method of operating a high-pressure discharge lamp as claimed in claim 1, comprising the steps of pre-heating the bulb structure (2) by supplying an electrical pre-heating current to said at least one electrode by applying a voltage across the separate and insulated external current supply leads to thereby pass a current through the narrow V-shaped at least one electrode (16) and heat the electrode;

removing the heater voltage connected between said external current supply leads leading to the at least one V-shaped electrode, connecting said external current supply leads in parallel, applying a high-voltage pulse between at least one of said external current supply leads leading to said at least one V-shaped electrode, and the other electrode (9); and applying operating voltage to said parallel connected external current supply leads and that one of the external current supply leads (6) connected to the other electrode (9) at a level sufficient to strike an arc between the electrodes.

11. A method of operating a high-pressure discharge lamp as claimed in claim 6, comprising the steps of pre-heating the bulb structure (2) by supplying an electrical pre-heating current to both said electrodes by applying a voltage across the separate and insulated external current supply leads (12, 13; 12', 13') to thereby pass a current through the narrow V-shaped electrodes (16, 16') and heat the electrodes;

removing the heater voltage connected between said external current supply leads leading to the respective V-shaped electrode, connecting the external current supply leads of each respective electrode in parallel, applying a high-voltage pulse to at least one of the respective external current supply leads (13, 13') leading to a respective V-shaped electrode, and applying operating voltage to said parallel connected external current supply leads (12, 13; 12', 13') and hence across said electrodes (16, 16') at a level sufficient to strike an arc between the electrodes.

12. The method of claim 10, wherein said step of supplying electrical preheating current comprises applying electrical current at a level sufficient for preheating the bulb structure and the fill therein to effect essentially entire vaporization of the fill within the bulb structure.

13. The method of claim 11, wherein said step of supplying electrical preheating current comprises applying electrical current at a level sufficient for preheating the bulb structure and the fill therein to effect essentially entire vaporization of the fill within the bulb structure.

14. The lamp of claim 1, wherein said lamp has a power rating of up to about 100W.

15. The lamp of claim 1, wherein the lamp has a power rating of up to about 100W; and wherein the internal volume of said bulb structure, within which said electrodes are located, is in the order of up to about 1 $cm^3$, and the at least one V-shaped electrode extends within the bulb structure and is dimensioned and shaped to provide for heating of the interior of the bulb structure, when energized by the energy source, sufficient to effect essentially entire vaporization of the fill within the bulb structure.

16. The lamp of claim 1, wherein the internal volume of said bulb structure is in the order of up to about 1 $cm^3$.

17. The lamp of claim 6, wherein said lamp has a power rating of up to about 100W.

18. The lamp of claim 6, wherein the power rating of said lamp is only up to about 50W.

19. The lamp of claim 6, wherein the internal volume of said bulb structure is up to about 0.03 $cm^3$.

20. The lamp of claim 19, wherein the lamp has a power rating of up to about 50W; and wherein the internal volume of said bulb structure, within which said electrodes are located, is in the order of up to about 0.03 $cm^3$ and the at least one V-shaped electrode extends within the bulb structure and is dimensioned and shaped to provide for heating of the interior of the bulb structure, when energized by the energy source, sufficient to effect essentially vaporization of the fill within the bulb structure.

* * * * *